United States Patent [19]

Gearhart

[11] Patent Number: 4,798,547

[45] Date of Patent: Jan. 17, 1989

[54] FUEL EFFICIENT PROPULSOR FOR OUTBOARD MOTORS

[75] Inventor: Walter S. Gearhart, State College, Pa.

[73] Assignee: The United States of America as represented by the Secretary of the Navy, Washington, D.C.

[21] Appl. No.: 68,995

[22] Filed: Jun. 29, 1987

[51] Int. Cl.[4] ..... B63H 5/16

[52] U.S. Cl. ..... 440/66; 440/78

[58] Field of Search ..... 440/49, 66–69, 440/78, 79

[56] References Cited

U.S. PATENT DOCUMENTS

| | | | |
|---|---|---|---|
| 803,671 | 11/1905 | Curtis | 440/66 |
| 1,386,835 | 8/1921 | Birkett | 440/66 |
| 2,705,469 | 4/1955 | Kohnenkamp | 440/66 |
| 3,139,853 | 7/1964 | McCarthy | 440/66 |
| 3,788,267 | 1/1974 | Strong | 440/66 |
| 4,096,819 | 6/1978 | Evinrude | 440/66 |
| 4,205,618 | 6/1980 | Olsson | 440/66 |
| 4,304,557 | 12/1981 | Henrich | 440/66 |
| 4,443,202 | 4/1984 | Arena | 440/66 |
| 4,445,452 | 5/1984 | Loch | 440/66 |
| 4,487,152 | 12/1984 | Larson | 440/66 |
| 4,529,387 | 7/1985 | Brandt | 440/66 |
| 4,631,036 | 12/1986 | Grothues-Spork | 440/66 |

FOREIGN PATENT DOCUMENTS

| | | | |
|---|---|---|---|
| 858213 | 10/1952 | Fed. Rep. of Germany | 440/66 |
| 58-98926 | 1/1983 | Japan | 440/66 |

*Primary Examiner*—Joseph F. Peters, Jr.
*Assistant Examiner*—Edwin L. Swinehart
*Attorney, Agent, or Firm*—K. W. Dobyns; Sol Sheinbein

[57] ABSTRACT

Vanes are mounted to an assembly affixed upstream of propeller blades of an outboard motor, creating a counterswirl in the fluid flow to counter the swirl produced by the propeller rotation, enabling on essentially axial discharge jet. The vanes are applied to only a 180 degree sector of the inflow to the propeller.

2 Claims, 2 Drawing Sheets

FUEL EFFICIENT PROPULSOR FOR OUTBOARD MOTORS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a propeller drive unit for motorboats and more particularly to a fuel efficient propulsor for motorboats.

It is the purpose of the marine propulsor to convert rotational shaft energy into a propulsive thrust. Ideally, this conversion is to be accomplished with the most efficient, vibration-free and inexpensive device. However, emphasis on achieving a particular goal such as efficiency, propulsor weight, mechanical simplicity or cavitation resistance may limit the designer in the type of propulsor configuration to be selected.

The most common and simplest propulsor that has been applied is the standard open propeller. A propeller operating in water experiences energy losses by two mechanisms. There are frictional losses as the blades pass through the fluid. An efficiency loss also occurs because energy is transferred to fluid by the blading and is lost in the slipstream.

Power losses associated with frictional effects on a rotating blade are approximately proportional to the cube of the blade-surface velocity and the wetted surface area of the propeller. To reduce frictional losses, the propeller should be small in diameter and have a minimum number of blades of small chord. The frictional losses are also reduced if the propulsor is designed to have a relatively high advance coefficient (ratio of ship speed to tip velocity of propeller blades). The blade-surface velocity will then be reduced to a value approaching the forward speed of the ship.

Reduction of frictional losses implies a small diameter propeller and a small mass flow rate of fluid through the propeller. The thrust produced is proportional to the product of the mass flow rate and the change in axial velocity of the fluid passing through the propeller. Therefore, producing a given value of thrust with a small mass flow rate requires large, changes in axial velocity and an excessively high slipstream velocity. A discharge jet with a high velocity results in low propulsive efficiency due to the large amount of kinetic energy that is dumped overboard in the jet. The high value of advance coefficient desired to reduce frictional losses requires the transfer of a large component of tangential velocity (swirl) to the fluid. For a small diameter propeller with a high advance coefficient, large kinetic energy losses are associated with both the axial and tangential components of slipstream velocity which decrease the efficiency of the propulsor.

It is evident that efforts to reduce frictional losses and kinetic energy losses in the slipstream dictate opposing design features, the highest efficiency achievable only by a proper balance between them.

The typical inboard or outboard motorboat has a high fuel consumption. The primary reason for this high fuel consumption is the low efficiency of the propeller and the fact that the roll or torque imbalance created by the propeller imparting angular momentum to the fluid must be reacted by the boat running at a condition that is not true and level. Ongoing efforts to provide fuel efficient power devices are quite important due to the high cost of fuel. It is thus desirable to reduce the high fuel consumption of such a system by reducing the swirl placed in the flow of the fluid and the torque imbalance on the boat.

OBJECTS OF THE INVENTION

It is therefore an object of the present invention to provide an improved fuel efficient propulsor for motorboats and the like.

Another object of the invention is to provide swirl in the water from the upstream to counteract the swirl created in the propeller during the motion of the boat.

Still another object of the present invention is to provide a swirl-free slipstream during motorboat movement.

Yet another object of the invention is to reduce high fuel consumption on a motorboat.

The objectives and advantages of the present invention are accomplished by locating a set of vanes upstream of a propeller of an outboard motor which places swirl in the flow counter to propeller rotation. Stationary counterswirl vanes are applied to only one-half of the inflow to the propeller, the other 180 degree sector not requiring counterswirl vanes. The propeller at design conditions will remove this swirl and the final slipstream will be essentially axial. This will provide a torque balanced propulsor and reduce the energy losses due to the swirl in the slipstream.

These and other objects and advantages and novel features of the invention will become apparent from the following detailed description of the invention when considered in conjunction with the accompanying drawings wherein:

DESCRIPTION OF THE PREFERRED EMBODIMENT

Figure 1:
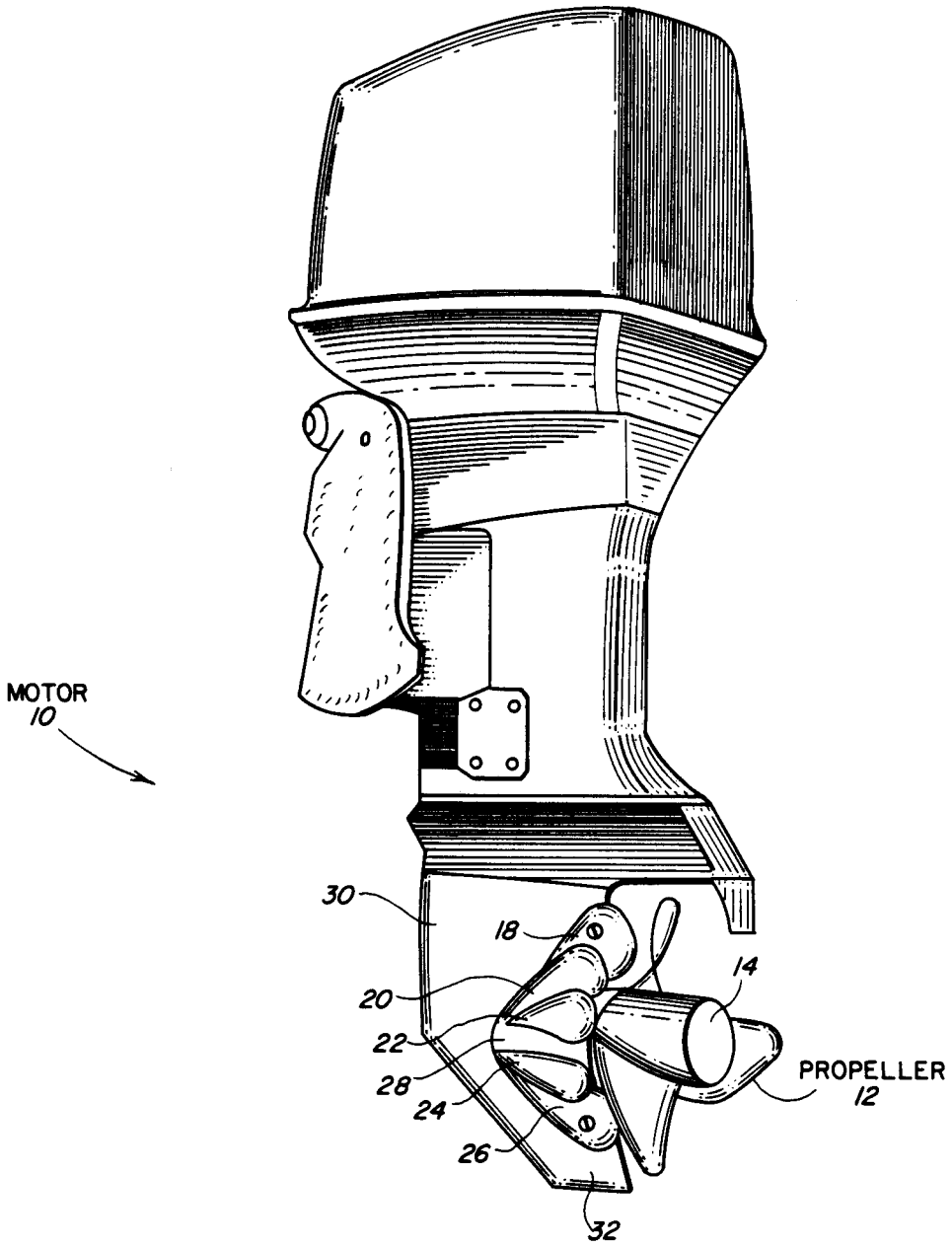
FIG. 1 is a perspective side view of a motorboat including the propeller thereof which is fitted with counterswirl vanes.

Referring to the drawings wherein like reference characters designate identical or corresponding parts throughout the several figures and more particularly to FIG. 1 thereof, a perspective view of the motor 10 including the modified fuel efficient propulsor is shown. A substantially conventional outboard motor 10 includes a propeller 12 having blades mounted on and driven by a horizontal shaft 14, the motor adapted to be attached to a boat 16.

Figure 2:
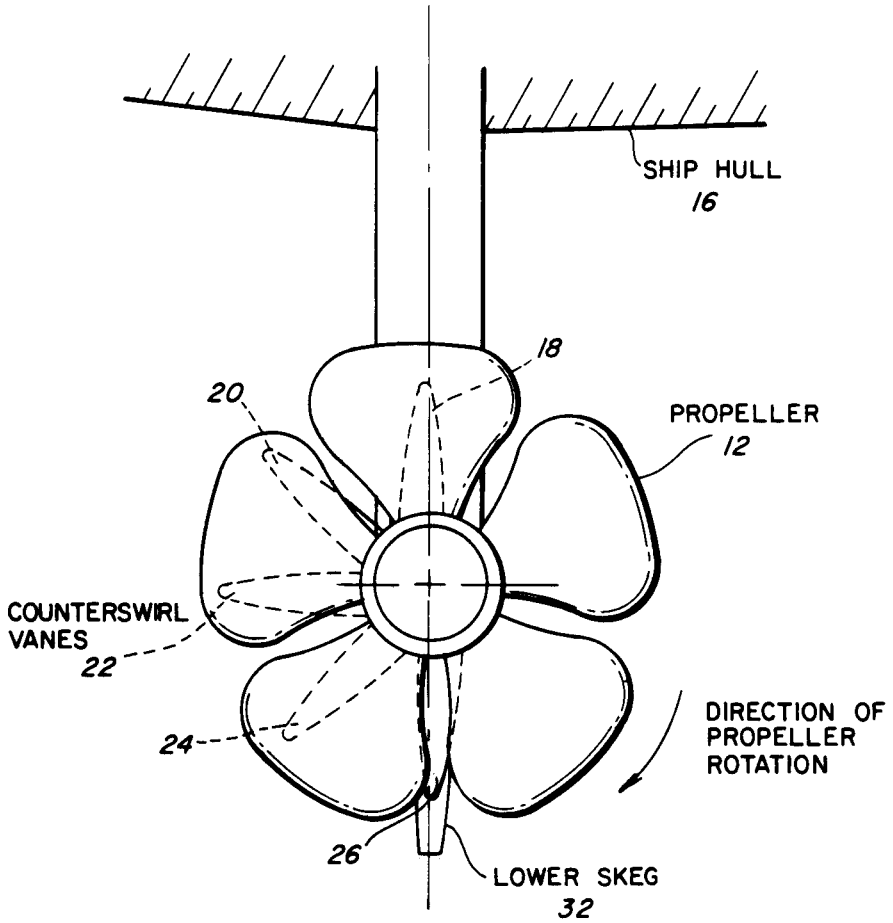
FIG. 2 is a forward looking view of the propeller.

Boat 16 typically cruises through the water with some dynamic trim angle with the water surface. This results in a flow over the stern of the boat that has an upwash or upwards component of velocity relative to the propeller. In addition, the dynamic trim of the boat 16 which raises the bow of the boat tends to orient the axis of the propeller 12 with respect to the inflow. The result is that the propeller 12 operates in an inflow that is not normal to the plane of the propeller but oblique to it. Thus, counterswirl actually exists in the inflow to the propeller 12 in the right hand sector of FIG. 2, showing the forward looking view of the propeller. Counterswirl vanes are therefore only needed in the left-hand sector of the propeller 12.

Five stationary counterswirl vanes 18, 20, 22, 24, 26 are mounted on a sleeve 28 to form a preswirl vane assembly. The vane assembly is then bolted to the upper strut 30 and lower skeg 32 of motor 10 upstream of the propeller 12. The dimensions of the vanes are such that their lengths from the center of shaft 14 are approximately that of the lengths of the blades of propeller 12. The vane assembly is spaced forward of propeller 12 by a distance approximately equal to the propeller diameter. The spacing and location of the vane assembly about the axis of rotation is not symmetrical but basically covers the inflow of the left hand sector of the propeller blade.

The swirling motion imparted to the fluid flow by the stationary counterswirl vanes 16, 18, 20, 22, and 24, produces a counterswirl in such a way so as to counter the swirl produced by the propeller 12, thus making the discharge from the propeller essentially axial, reducing the losses associated with the swirl in the slipstream of the water.

There has therefore been described an improved propulsor for motorboats. Location of stationary counterswirl vanes over only one half of the inflow to the propeller reduces the wetted surface area, and the drag associated with stationary vanes is reduced. The presence of the stationary counterswirl vanes acts to reduce buffeting in choppy waters. The shape and geometry of the vanes are such that they tend to resist fouling with debris and deflect debris before impacting and damaging the propeller. The unsymmetric location of the stationary vanes results in a net lift on the rear of the boat which tends to reduce the dynamic trim at the boat and its net drag. The torque unbalance to the boat, which is generated by the rotating propeller, is reduced by this arrangement.

The vanes reduce the swirl to zero and therefore energy losses in the propeller slipstream are reduced and the propeller efficiency is increased, reducing fuel consumption. The advantage of applying counterswirl to only a 180 degree sector is that approximately the same propeller shaft torque for a given shaft rpm is required when the counterswirl vanes are installed. Thus, the torque to rpm characteristics of the propeller is unchanged and therefore does not require the purchase of a new propeller.

Modification and variation of the present invention is possible in light of the above teachings. As an example, the position, dimensions and number of the stationary counterswirl vanes employed to reduce the swirl produced by the motion of the propeller blades can be changed without deviating from the teachings of the subject invention. Moreover, the vanes could be cast directly with the motor strut rather than bolted thereto. It is therefore to be understood that within the scope of the attached claims the invention may be practiced otherwise than as specifically described.

What is claimed as new and desired to be secured by Letters Patent is:

1. A fuel efficient propulsor for a motorboat moving in a fluid, comprising:

an outboard motor including a horizontal shaft having a propeller mounted thereon; and a vane assembly mounted forward of said propeller, said assembly comprising a plurality of stationary vanes applied to only one half of the fluid inflow to the propeller covering the inflow to the left hand side of the propeller looking forward, to produce a swirl in the fluid counter to the swirl generated at said propeller.

2. A propulsor as recited in claim 1 wherein said plurality of vanes comprises five vanes unsymmetrically located about the axis of rotation of said propeller.

* * * * *